US009891550B2

(12) United States Patent
Mandai et al.

(10) Patent No.: US 9,891,550 B2
(45) Date of Patent: Feb. 13, 2018

(54) DEVELOPING DEVICE WHICH CAN DETECT ROTATIONAL POSITION OF DEVELOPING ROLLER

(71) Applicant: Konica Minolta, Inc., Chiyoda-ku, Tokyo (JP)

(72) Inventors: Yuusuke Mandai, Kyoto (JP); Kazuya Kitamura, Nagoya (JP); Masato Kimura, Toyoake (JP); Kanji Nakayama, Toyokawashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/292,611

(22) Filed: Oct. 13, 2016

(65) Prior Publication Data

US 2017/0108797 A1 Apr. 20, 2017

(30) Foreign Application Priority Data

Oct. 14, 2015 (JP) ..... 2015-202839

(51) Int. Cl.
*G03G 15/06* (2006.01)
*G03G 15/08* (2006.01)

(52) U.S. Cl.
CPC ..... *G03G 15/065* (2013.01); *G03G 15/0824* (2013.01); *G03G 15/0825* (2013.01); *G03G 15/0893* (2013.01); *G03G 2215/0132* (2013.01); *G03G 2215/0838* (2013.01)

(58) Field of Classification Search
CPC ..... G03G 15/065
See application file for complete search history.

(56) References Cited

U.S. PATENT DOCUMENTS

| | | | | |
|---|---|---|---|---|
| 7,058,325 B2 * | 6/2006 | Hamby | G03G 15/5062 | 399/49 |
| 2007/0116482 A1 * | 5/2007 | Ichikawa | G03G 15/5033 | 399/49 |
| 2007/0127937 A1 * | 6/2007 | Ichikawa | G03G 15/0131 | 399/49 |
| 2007/0196116 A1 * | 8/2007 | Watanabe | G03G 15/0853 | 399/258 |

FOREIGN PATENT DOCUMENTS

| | | |
|---|---|---|
| JP | 06095490 A | 4/1994 |
| JP | 2000098675 A | 4/2000 |
| JP | 2015004875 A | 1/2015 |

* cited by examiner

*Primary Examiner* — Benjamin Schmitt
*Assistant Examiner* — Milton Gonzalez
(74) *Attorney, Agent, or Firm* — Cantor Colburn LLP

(57) ABSTRACT

A developing device is equipped with a developing roller rotationally driven for developing an electrostatic latent image formed on a surface of an image supporting body with toner, a screw rotationally driven of which a ratio of number of rotations to number of rotations of the developing roller being rotationally driven is constant, and a processor. The processor is configured to detect toner density in developer by using a sensor installed facing the screw, during rotationally drive of the screw, and detect information indicating a rotational position of the developing roller, based on ripples which occur in the toner density detected.

17 Claims, 14 Drawing Sheets

DEVELOPING DEVICE WHICH CAN DETECT ROTATIONAL POSITION OF DEVELOPING ROLLER

CROSS REFERENCE TO RELATED APPLICATIONS

This application is based on Japanese Patent Application No. 2015-202839 filed with the Japan Patent Office on Oct. 14, 2015, the entire content of which is hereby incorporated by reference.

BACKGROUND OF THE INVENTION

Field of the Invention

This invention relates to a developing device, an image forming apparatus, and a control program of a developing device. More specifically, this invention relates to a developing device, an image forming apparatus, and a control program of a developing device, which can detect a rotational position of a developing roller, preventing complication of the device configuration.

Description of the Related Art

As electrophotographic image forming apparatuses, there are an MFP (Multi Function Peripheral) which has a scanner function, a facsimile function, a copying function, a function of a printer, a data transmitting function and a server function, a facsimile device, a copying machine, a printer, and so on.

An image forming apparatuses generally develop an electrostatic latent image formed on an image supporting body to form a toner image After transferring the toner image onto a sheet, a fixing device fixes the toner image on the sheet to form an image on the sheet. Some image forming apparatuses develop an electrostatic latent image on a surface of a photo conductor by using a developing device, to form a toner image, and transfer the toner image to a secondary transfer belt by using a primary transfer roller. The toner image on the secondary transfer belt is secondary transferred to a sheet by using a secondary transfer roller. In this instance, the photo conductor and the secondary transfer belt act as image supporting bodies.

In an electrophotographic process, density ununiformity (periodical ununiformity) may occur in the developing cycle in the sub scanning direction of the toner image, due to runout of an outer shape of the developing roller, when an electrostatic latent image is developed with toner by the developing roller of the developing device. An idea of a method for suppressing the density ununiformity is to adopt stricter screening criteria (inspection criteria) relating to runout of developing rollers at the time of manufacture of image forming apparatuses, to employ only image rollers of which the runout is small. However, since the method causes decreasing in yield of developing rollers, the method has a problem in that it causes increasing the cost of an image forming apparatus.

Another method for suppressing the periodical ununiformity above mentioned is to match phases of both a rotation period of a developing roller and a cycle of density ununiformity in the circumferential direction of the developing roller, wherein the density ununiformity is detected by an image density reading sensor. According to the method, the periodical ununiformity is reduced and suppressed. According to the method, a disk with slits is installed on the rotation shaft of the developing roller. The disk is detected by a photo sensor, such as a photo interrupter, or an encoder, so that the rotational position of the developing roller is detected.

The Document 1 below discloses a technique for detecting a rotational position of a developing roller by using a photo interrupter. According to the technique, a detection plate is directly connected to the rotation shaft of the developing roller. The detection plate rotates in conjunction with the developing roller. The detection plate has a slit. The photo interrupter detects the slit of the detection plate on every rotation of the detection plate, to detect the rotational position of the developing roller.

[Document 1] Japan Patent Publication No. 2000-98675

However, according to the another method above mentioned, a detector such as a photo interrupter or an encoder should be newly installed on a developing device. It has a problem which causes the complication of the device configuration and increase in the cost. Especially, from the viewpoint of the cost, the increase in a cost when a detector is newly installed is almost of the same as the increase in a cost when adopting stricter screening criteria relating to runout of developing rollers. Therefore, the another method above mentioned does not receive benefit by cost reduction.

SUMMARY OF THE INVENTION

This invention is to solve the above problems. The object is to provide a developing device, an image forming apparatus, and a control program of a developing device which can detect a rotational position of a developing roller, preventing the device configuration from being complex.

To achieve at least one of the above-mentioned objects, a developing device reflecting one aspect of the present invention comprises: a developing roller rotationally driven, for developing an electrostatic latent image formed on a surface of an image supporting body with toner, a screw rotationally driven, of which a ratio of number of rotations to number of rotations of the developing roller being rotationally driven is constant, and a processor, wherein the processor is configured to detect first toner density in developer by using a sensor installed facing the screw, during rotationally drive of the screw, and detect information indicating a rotational position of the developing roller, based on ripples which occur in the first toner density detected.

Preferably, the processor is further configured to: detect second toner density in a toner image formed on the surface of the image supporting body, during rotationally drive of the screw, and detect the information indicating the rotational position of the developing roller, further based on the second toner density detected.

Preferably, the processor is further configured to: detect a deviation amount between periodicity of the ripples and periodicity of the second toner density detected.

Preferably, the processor is further configured to: calculate a curved line which indicates relationship between the rotational position of the developing roller and a developing bias, based on the second toner density detected and the deviation amount, wherein the developing bias is an electrical voltage applied to the developing roller when the developing roller develops the electrostatic latent image.

Preferably, the processor is further configured to: detect the first toner density and the second toner density, in a state that system speed is slower than system speed of normal image forming.

Preferably, the processor is further configured to: detect the first toner density and the second toner density, in a state that a ratio of the rotational speed of the developing roller to a rotational speed of the image supporting body is reduced from normal image forming.

Preferably, the processor is further configured to: detect the first toner density and the second toner density, in a state that the toner density in the developer is lowered from normal image forming.

Preferably, the processor is further configured to: detect the first toner density and the second toner density, when a new developing device is installed on an image forming apparatus.

Preferably, a rotational speed of faster of the developing roller and the screw is an integral multiple of a rotational speed of slower of the developing roller and the screw.

Preferably, the developing device further comprises: a housing in which developer is stored, an agitating screw to convey the developer, agitating the developer, and a feeding screw to provide the developer conveyed by the agitating screw for the developing roller, wherein the housing includes a partition wall which separates the agitating screw and the feeding screw, and the sensor is provided near an aperture which is made on the wall, facing the agitating screw.

Preferably, the developing device further comprises: a detection subsidiary part which is fixed to the screw at a location facing the sensor, to improve sensitivity of the ripples.

Preferably, the detection subsidiary part extends parallel with an axis of rotation of the screw between spiral protruding portions which are formed on an outer periphery of a rotation shaft of the screw, wherein the spiral protruding portions constitute the screw.

Preferably, the detection subsidiary part gets thinner, with distance from the rotation shaft of the screw, viewed from an extending direction of the axis of rotation.

Preferably, the detection subsidiary part is made of an elastic body, and keeps contact with the housing contains the screw.

To achieve at least one of the above-mentioned objects, an image forming apparatus reflecting one aspect of the present invention comprises: the developing device, and a transfer device to transfer a toner image obtained by developing of the developing roller, to a recording medium.

DESCRIPTION OF THE PREFERRED EMBODIMENTS

The embodiments of this invention will be explained in the followings with the figures.

In the following embodiments, an image forming apparatus as an MFP is explained. An image forming apparatus may be a facsimile device, a copying machine, a printer, or the like.

[The First Embodiment]

Firstly, a structure of an image forming apparatus of the embodiment will be explained.

Figure 1:
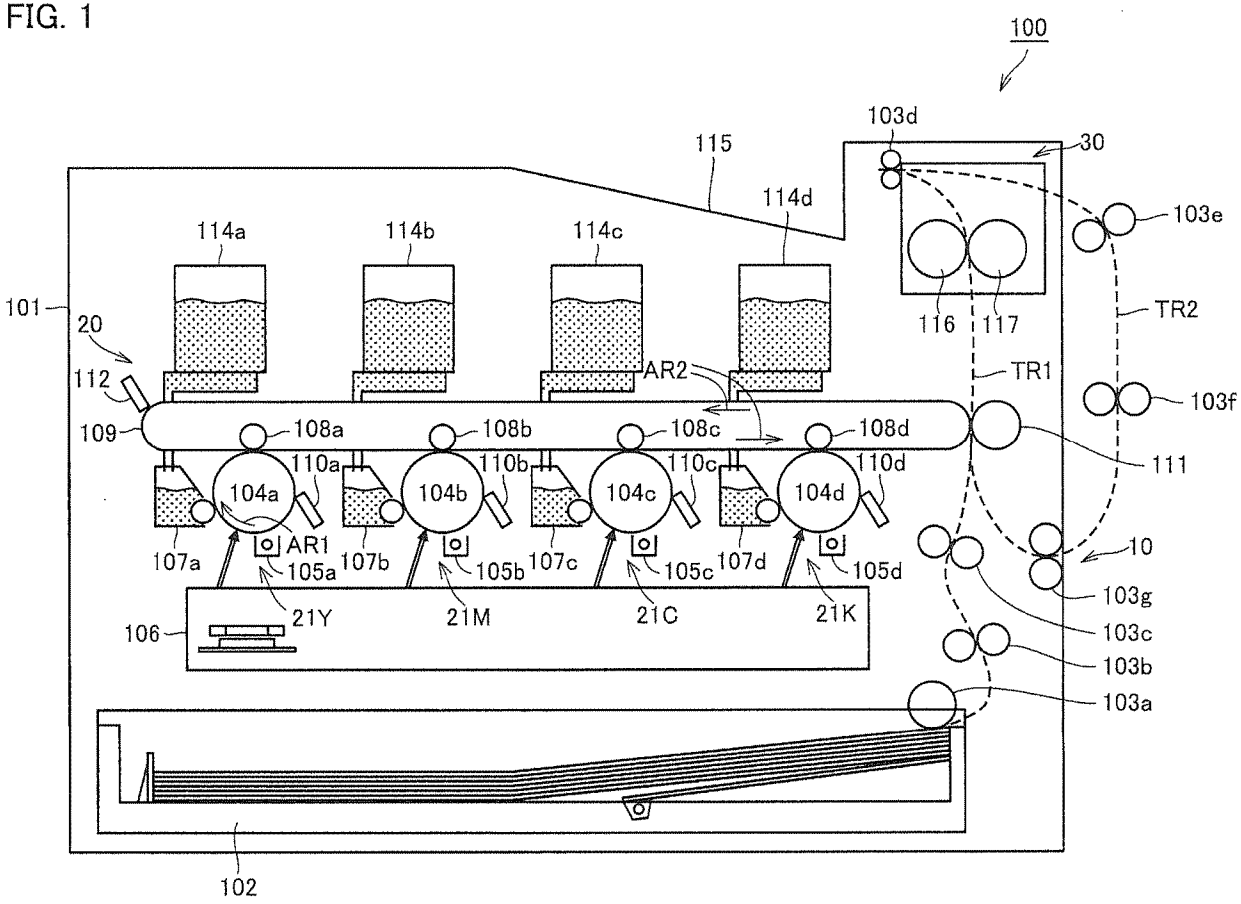
FIG. 1 shows a cross sectional view of a structure of image forming apparatus 100, according to the first embodiment of this invention.

FIG. 1 shows a cross sectional view of a structure of image forming apparatus 100, according to the first embodiment of this invention.

Referring to FIG. 1, image forming apparatus 100 according to the embodiment is an MFP which is basically equipped with sheet conveying unit 10, toner image forming unit 20, and fixing device 30.

Sheet conveying unit 10 includes paper feeding tray 102, paper feeding roller 103*a*, conveying rollers 103*b*, 103*c*, 103*e*, 103*f* and 103*g*, paper ejection roller 103*d*, and copy receiving tray 115. Paper feeding tray 102 stores sheets on which images are to be formed. Paper feeding tray 102 may include a plurality of paper feeding trays. Paper feeding roller 103*a* is provided between paper feeding tray 102 and conveying path TR1. Conveying rollers 103*b* and 103*c* are provided along with conveying path TR1. Conveying rollers 103*e*, 103*f* and 103*g* are provided along with conveying path TR2. Paper ejection roller 103*d* is provided at the most downstream side of conveying path TR1. Copy receiving tray 115 is provided at the top of the main body 101 of the image forming apparatus 100.

Toner image forming unit 20 synthesizes images of four colors of Y (yellow), M (magenta), C (cyan) and K (black) by so-called a tandem system, and transfers the toner image onto a sheet. Toner image forming unit 20 includes four image forming units 21Y, 21M, 21C and 21K, expose device (laser unit) 106, secondary transfer belt 109, primary transfer rollers 108*a*, 108*b*, 108*c* and 108*d*, secondary transfer roller 111, cleaning device 112, and so on.

Image forming units 21Y, 21M, 21C and 21K are parallely placed immediately below secondary transfer belt 109. Image forming unit 21Y includes photo conductor 104*a*, electrostatic charging roller 105*a*, developing device 107*a*, cleaning device 110*a*, and so on. Photo conductor 104*a* is rotationally driven in the direction shown by arrow AR1 in FIG. 1. Electrostatic charging roller 105*a*, developing device 107*a*, and cleaning device 110*a* are placed around photo conductor 104*a*.

Image forming unit 21M includes photo conductor 104*b*, electrostatic charging roller 105*b*, developing device 107*b*, cleaning device 110*b*, and so on Image forming unit 21C includes photo conductor 104*c*, electrostatic charging roller 105*c*, developing device 107*c*, cleaning device 110*c*, and so on. Image forming unit 21K includes photo conductor 104*d*, electrostatic charging roller 105*d*, developing device 107*d*, cleaning device 110*d*, and so on. Each of image forming units 21M, 21C and 21K has a same structure as image forming unit 21Y.

Expose device 106 is provided at the lower part of image forming units 21Y, 21M, 21C, and 21K. Secondary transfer belt 109 is provided at the upper part of image forming units 21Y, 21M, 21C, and 21K. Secondary transfer belt 109 is in the form of a ring, and is rotationally driven in the direction shown by arrow AR2 in FIG. 1, in conjunction with sheet conveying unit 10. Primary transfer rollers 108*a*, 108*b*, 108*c*, and 108*d* face photo conductors 104*a*, 104*b*, 104*c* and 104*d* respectively, interposing secondary transfer belt 109. Secondary transfer roller 111 is placed in contact with secondary transfer belt 109 at conveying path TR1. The distance between secondary transfer roller 111 and secondary transfer belt 109 is adjustable, by using a pressure contact and separation mechanism which is not shown in the figures. Cleaning device 112 is provided near secondary transfer belt 109. Primary transfer rollers 108*a*, 108*b*, 108*c*, 108*d*, secondary transfer belt 109, and secondary transfer roller 111 constitute a transfer device which transfers a toner image developed by developing roller 131 onto recording media.

Fixing device 30 includes heating roller 116 and pressure roller 117. Fixing device 30 pinches and conveys a sheet which holds a toner image, by a nip portion of heating roller 116 and pressure roller 117, along with conveying path TR1, to fix the toner image onto the sheet.

When image forming apparatus 100 receives an instruction of performing a printing job, recording media such as sheets stored in paper feeding tray 102 are one by one taken by paper feeding roller 103*a*, and conveyed along with conveying path TR1 by conveying rollers 103*b* and 103*c*. In parallel to the paper feeding, the surfaces of photo conductors 104*a*, 104*b*, 104*c* and 104*d* for YMCK colors are electrostatic charged by electrostatic charging rollers 105*a*, 105*b*, 105*c* and 105*d* of YMCK colors. After that, expose device 106 performs exposure based on image data. Herewith, electrostatic latent images are formed on the surfaces of photo conductors 104*a*, 104*b*, 104*c* and 104*d*. These electrostatic latent images are developed by developing devices 107*a*, 107*b*, 107*c* and 107*d* for YMCK colors with toner. Herewith, toner images are formed on the surfaces of photo conductors 104*a*, 104*b*, 104*c* and 104*d*. These toner images are transferred onto secondary transfer belt 109, by a transfer bias which is applied to primary transfer rollers 108*a*, 108*b*, 108*c* and 108*d* for YMCK colors. Herewith, toner images of YMCK colors are overlapped and formed on secondary transfer belt 109. After that, residual toner on the surface of photo conductors 104*a*, 104*b*, 104*c* and 104*d* is removed by cleaning devices 110*a*, 110*b*, 110*c* and 110*d* for YMCK colors.

A toner image on secondary transfer belt 109 is transferred onto a recording medium being conveyed between secondary transfer belt 109 and secondary transfer roller 111, by a secondary transfer bias applied to secondary transfer roller 111. After that, residual toner on secondary transfer belt 109 is removed by cleaning device 112.

Heat and pressure are applied to the toner image formed on the recording medium, when the recording medium passes through fixing device 30, to fix the toner image onto the recording medium. The recording medium on which the toner image was fixed is discharged onto copy receiving tray 115 by paper ejection roller 103*d*.

When toner in the inner part of one of developing devices 107*a*, 107*b*, 107*c* and 107*d* is reduced by image forming, toner stored in the inner part of corresponding one of toner bottles 114*a*, 114*b*, 114*c* and 114*d* of YMCK colors is supplied to the one of developing devices 107*a*, 107*b*, 107*c* and 107*d*. Toner bottles 114*a*, 114*b*, 114*c* and 114*d* are detachable. When toner in the inner part of a toner bottle among toner bottles 114*a*, 114*b*, 114*c* and 114*d* is exhausted, a user replaces the toner bottle. Herewith, toner is continuously supplied to image forming apparatus 100.

When images are to be formed on both sides of the recording medium, paper ejection roller 103*d* is reversely rotated after the recording medium passed through fixing device 30, so that the recording medium enters conveying path TR2. The recording medium is conveyed by conveying rollers 103*e*, 103*f* and 103*g*, and fed into conveying path TR1 again. Then, a toner image is formed on the rear surface of the recording medium. After that, the recording medium is discharged onto copy receiving tray 115, by paper ejection roller 103*d*.

Hereinafter, a photo conductor, an electrostatic charging roller, and a developing device in an arbitrary image forming unit among image forming units 21Y, 21M, 21C, and 21K may be referred to as photo conductor 104 (an example of an image supporting body), electrostatic charging roller 105, and developing device 107 (an example of a developing device), respectively.

Figure 2:
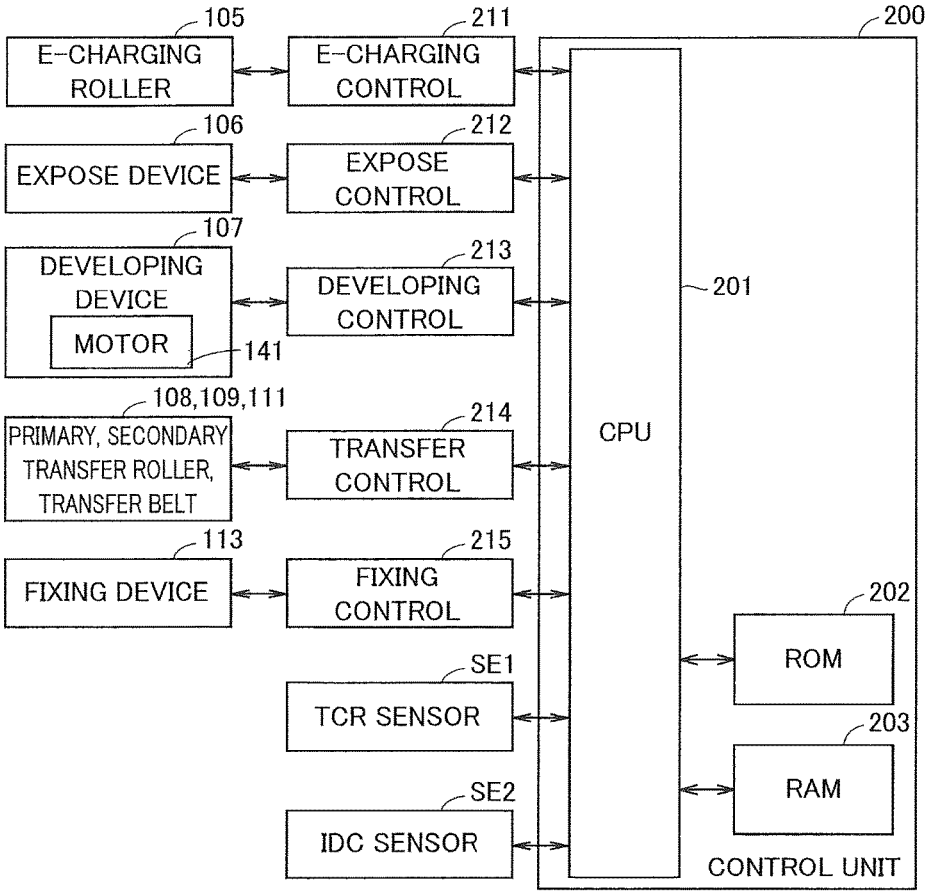
FIG. 2 shows a block diagram of a control structure of image forming apparatus 100, according to the first embodiment of this invention.

FIG. 2 shows a block diagram of a control structure of image forming apparatus 100, according to the first embodiment of this invention.

Referring to FIG. 2, image forming apparatus 100 is equipped with control unit 200, electrostatic charging control unit 211, expose control unit 212, developing control unit 213, transfer control unit 214, fixing control unit 215, TCR (Toner Carrier Ratio) sensor SE1, and IDC (Image Density Control) sensor SE2.

Control unit 200 includes CPU (Central Processing Unit) 201, ROM (Read Only Memory) 202, and RAM (Random Access Memory) 203. CPU 201, and each of ROM 202, RAM 203, electrostatic charging control unit 211, expose control unit 212, developing control unit 213, transfer control unit 214, fixing control unit 215, TCR sensor SE1 and IDC sensor SE2 are bilaterally connected with each other.

CPU 201 controls entire behavior of image forming apparatus 100. CPU 201 executes processing based on control programs.

ROM 202 stores control programs or the like, executed by CPU 201.

RAM 203 is a working memory for CPU 201, and temporarily stores data relating to various jobs.

Electrostatic charging control unit 211 controls behavior of electrostatic charging roller 105, such as electrical voltage applied to electrostatic charging roller 105, rotational speed of electrostatic charging roller 105, and so on.

Expose control unit 212 controls behavior of expose device 106, such as exposure light intensity, irradiate timing when photo conductors 104 is irradiated with exposure light.

Developing control unit 213 controls behavior of developing device 107, such as developing bias of developing device 107, suppliance of toner to developing device 107, rotational speed of motor 141 which drives parts in developing device 107, and so on.

Transfer control unit 214 controls behavior of each of primary transfer rollers 108, secondary transfer belt 109, and secondary transfer roller 111, such as primary transfer bias, primary transfer electrical current, contact pressure of primary transfer roller 108 to secondary transfer belt 109, rotational speed of secondary transfer belt 109, secondary transfer bias, and so on.

Fixing control unit 215 controls behavior of fixing device 113, such as temperature of heating roller 116, rotational speed of pressure roller 117, and so on.

TCR sensor SE1 outputs electrical voltage corresponding to magnetic permeability of developer present in a detection range.

IDC sensor SE2 outputs electrical voltage corresponding to toner density of a toner image formed on the surface of photo conductor 104.

Figure 3:
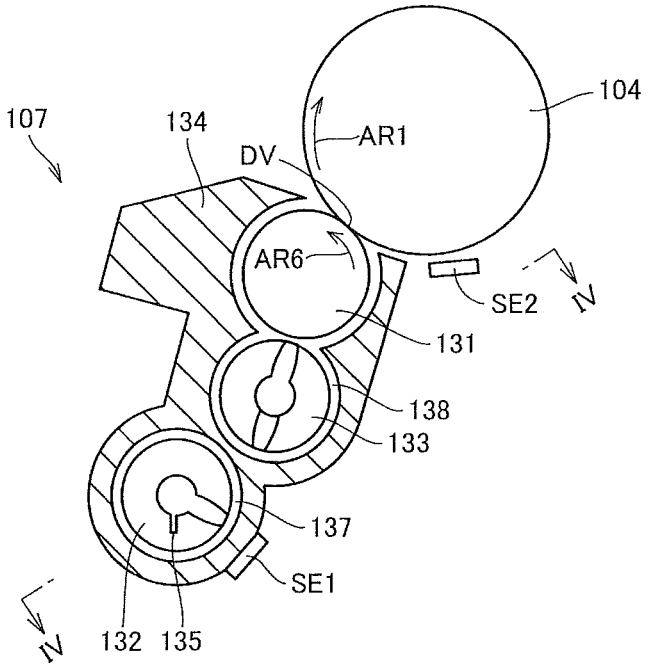
FIG. 3 shows a cross sectional view of a structure of developing device 107, according to the first embodiment of this invention.
Figure 4:
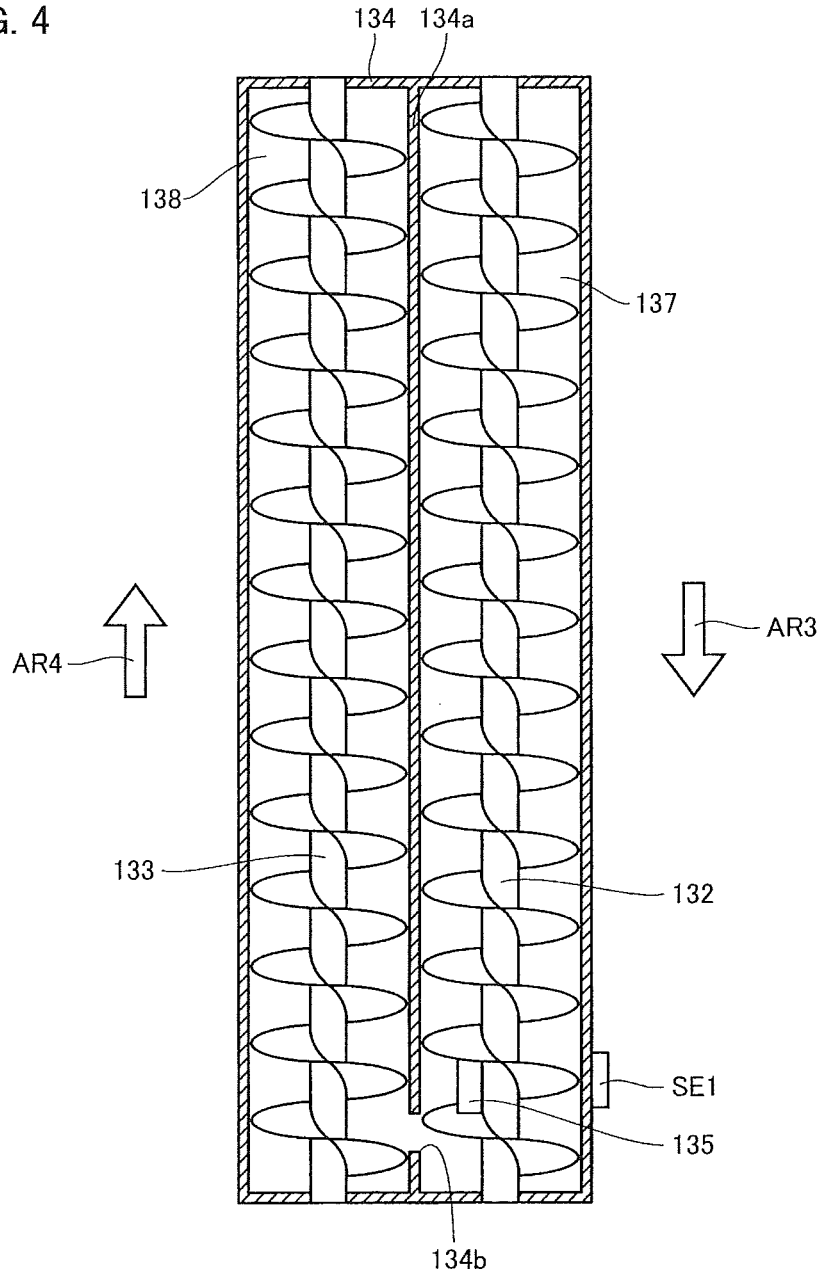
FIG. 4 shows a cross sectional view along IV-IV of FIG. 3.

FIG. 3 shows a cross sectional view of a structure of developing device 107, according to the first embodiment of this invention. FIG. 4 shows a cross sectional view along IV-IV of FIG. 3.

Referring to FIGS. 3 and 4, developing device 107 includes developing roller 131, agitating screw 132, feeding screw 133, and housing 134. Each of agitating screw 132 and feeding screw 133 has a circulating route which is formed oblique two axes with respect to developing roller 131.

Developer is stored in the inner part of housing 134. The inner part of housing 134 is partitioned into agitation tank 137 and feeding tank 138 by partition wall 134*a*. Agitating screw 132 is installed in agitation tank 137. Agitating screw 132 conveys developer in the direction shown by arrow AR3, agitating it to frictionally electrify toner in the developer. Aperture 134*b* is provided on partition wall 134*a* at the most downstream side in the direction shown by arrow AR3. The developer in agitation tank 137 is drawn into feeding tank 138, via aperture 134*b*.

Feeding screw 133 is installed in feeding tank 138. Feeding screw 133 provides developing roller 131 with developer conveyed by agitating screw 132, which includes toner electrostatically charged, conveying the developer in the direction shown by arrow AR4. The residual developer which was not provided for developing roller 131 is drawn down from feeding tank 138 to agitation tank 137.

Developing roller 131 is rotationally driven in the direction shown by arrow AR6, to catch developer from feeding screw 133 by magnetic force. When developer is conveyed on developing roller 131, a conveying amount of developer is quantified by a regulation blade (which is not shown in Figures), and the developer is frictionally electrified. After that, toner contained in the developer conveyed by developing roller 131 is supplied to the surface of photo conductor 104 at the developing location DV, by difference in electrical potential between a developing bias (electrical voltage applied to developing roller 131 when developing roller 131 develops an electrostatic latent image) and the surface electrical potential of photo conductor 104. The developing location DV is a portion which faces photo conductor 104. Herewith, an electrostatic latent image formed on the surface of photo conductor 104 is developed with toner, so that a toner image is formed on the surface of photo conductor 104.

Developing roller 131, agitating screw 132, and feeding screw 133 are rotationally driven by a same motor 141 via gears. The ratio of revolutions of agitating screw 132 and feeding screw 133 to revolutions of developing roller 131 is 1 to 1, for example. Therefore, rotation phases of developing roller 131, agitating screw 132, and feeding screw 133 are same at all times, and not deviated.

The ratio of revolutions of agitating screw 132 and feeding screw 133 to revolutions of developing roller 131 during rotational driving is not limited to as presented above 1 to 1. The faster one of the rotational speed of developing roller 131 and the rotational speed of agitating screw 132 is preferably the integral multiple of the slower one of the rotational speed of developing roller 131 and the rotational speed of agitating screw 132. A structure which makes a ratio of revolutions of agitating screw 132 to revolutions of developing roller 131 constant is arbitrary. The structure may employ gears, belts, transmissions driven, or the like.

The toner/carrier ratio Tc of the residual developer remained on developing roller 131 after developing, is decreased from normal developer, since the toner was consumed. The residual developer is recovered into agitation tank 137 via the two axes circulating route, by feeding screw 133. Image forming apparatus 100 detects toner density in the developer by using TCR sensor SE1, during rotational drive of agitating screw 132. When outputting electrical voltage of TCR sensor SE1 decreases, image forming apparatus 100 determines that the toner/carrier ratio Tc (the toner density in the developer) of developer in agitation tank 137 is decreased. In such a case, image forming apparatus 100 supplies toner from one of toner bottles 114*a*, 114*b*, 114*c*, and 114*d*, to restore the toner/carrier ratio Tc. TCR sensor SE1 is preferably provided near aperture 134*b* provided on partition wall 134*a*, facing agitating screw 132. Since developer is moved from agitating screw 132 to feeding screw 133 around aperture 134*b*, so that developer temporarily remains around aperture 134*b*, and the powder pressure of the developer tends to be higher. By providing TCR sensor SE1 near aperture 134*b*, the toner/carrier ratio Tc of developer with high powder pressure can be measured, so that the occurrence of ripples can be detected with more precision.

Image forming apparatus 100 performs an image stabilization process at necessary timing, to form toner images with proper toner density when developing of developing device 107. The image stabilization process is to optimize difference in electrical potential between developing roller 131 and photo conductor 104 when developing Image forming apparatus 100 sets difference in electrical potential between developing roller 131 and photo conductor 104 to a preset value, and forms a toner image on the surface of photo conductor 104. Image forming apparatus 100 measures toner density of the toner image on the surface of photo conductor 104, by using IDC sensor SE2. Image forming apparatus 100 corrects difference in electrical potential between developing roller 131 and photo conductor 104 during developing, based on the measured toner density. IDC sensor SE2 is provided near the surface of photo conductor 104.

According to the embodiment, information to indicate the rotational position of developing roller 131 is detected, by using TCR sensor SE1 and IDC sensor SE2 installed in a conventional image forming apparatus. More specifically, image forming apparatus 100 detects information to indicate the rotational position of developing roller 131 based on ripples occurred in toner density detected by using TCR sensor SE1 and fluctuation of toner density detected by using IDC sensor SE2 during rotational drive of agitating screw 132.

Next, the detection method for information to indicate the rotational position of developing roller 131 according to the embodiment will be explained.

Figure 5B:
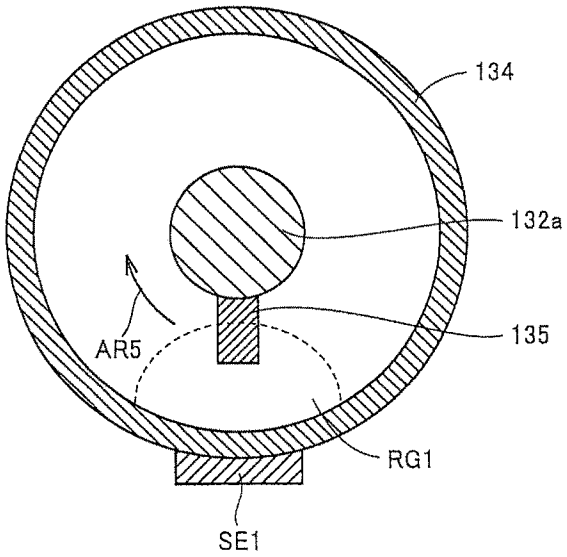
FIGS. 5A and 5B show a cross sectional view of a structure adjacent to agitating screw 132 in developing device 107 of the first embodiment of this invention.
Figure 5A:
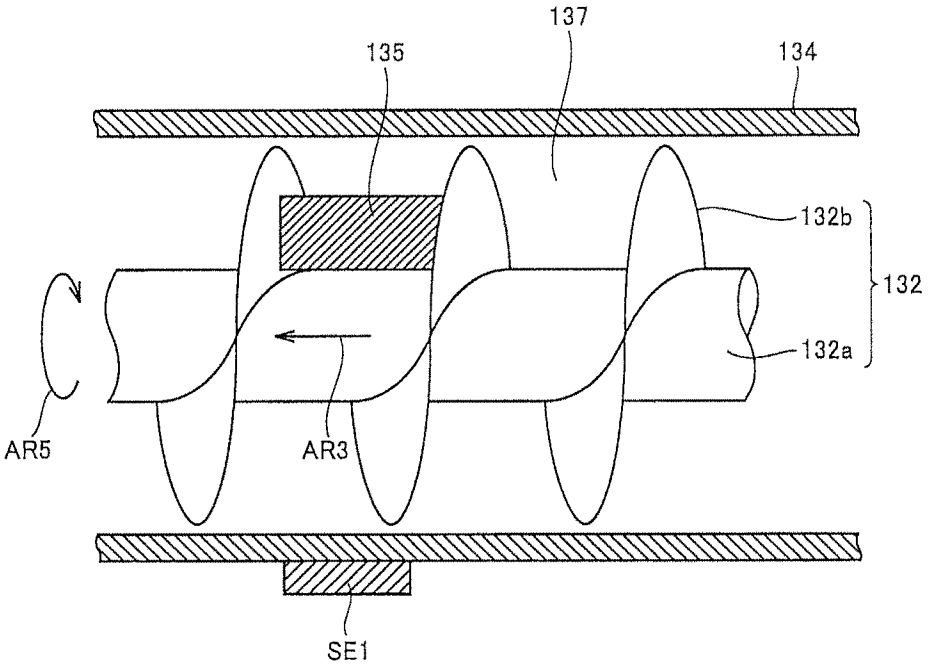

FIGS. 5A and 5B show a cross sectional view of a structure adjacent to agitating screw 132 in developing device 107 of the first embodiment of this invention. FIG. 5A is a cross sectional view showing a cross section parallel to the extending direction of rotation shaft 132*a*. FIG. 5B is a cross sectional view showing a cross section plane of which the normal line extends in the extending direction of rotation shaft 132*a*.

Referring to FIGS. 5A and 5B, agitating screw 132 includes rotation shaft 132*a*, spiral blade 132*b*, and detection subsidiary part 135. Spiral blade 132*b* is a spiral protruding portion installed on rotation shaft 132*a*, with a predetermined pitch. Detection subsidiary part 135 is a paddle, and fixed on an outer periphery of rotation shaft 132*a*. Detection subsidiary part 135 extends parallel with rotation shaft 132*a*, in a portion of spiral blade 132*b*, wherein the portion faces TCR sensor SE1. Detection subsidiary part 135 is to improve the sensitivity of ripples. Detection subsidiary part 135 may be integrally molded with rotation shaft 132*a* and spiral blade 132*b*. Detection subsidiary part 135 should have magnetic permeability which is different from magnetic permeability of developer. Detection subsidiary part 135 is preferably made of non-magnetic material, such as resin.

Agitating screw 132 rotates in the direction shown by arrow AR5. Thereby, developer is conveyed in the direction shown by arrow AR3. TCR sensor SE1 outputs electrical voltage corresponding to magnetic permeability of developer presents in detection range RG1 in agitation tank 137, wherein detection range RG1 faces TCR sensor SE1. The carrier contained in developer is magnetic material. Therefore, when toner density in the developer decreases, the percentage of carrier in the developer increases. In this case, measured magnetic permeability increases, and toner/carrier ratio Tc decreases.

Detection subsidiary part 135 enters detection range RG1 at time intervals corresponding to the rotation period of agitating screw 132. Hence, outputting electrical voltage of TCR sensor SE1 (magnetic permeability in detection range RG1) fluctuates in a rotation period of agitating screw 132. In consequence, in the output waveform of TCR sensor SE1, a ripple is generated in a rotation period of agitating screw 132. The ripple is noise, in terms of measurement of toner/carrier ratio Tc in developer. Therefore, toner/carrier ratio Tc of developer is typically detected based on magnetic permeability measured, avoiding the ripples. The output waveform of TCR sensor SE1 tends to include a ripple in the rotation period of agitating screw 132, by nature. Therefore, ripples can be detected without detection subsidiary part 135.

Figure 6A:
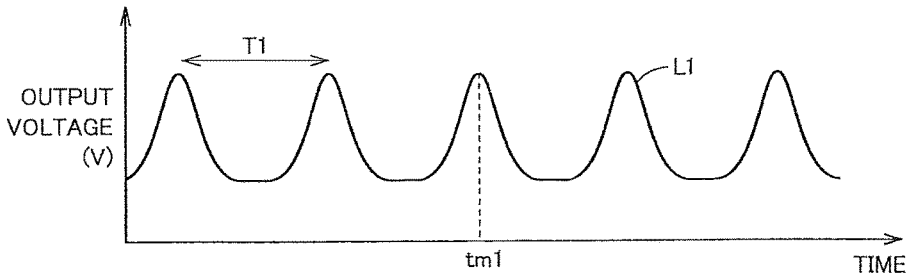
FIGS. 6A-6C is for explanation pertaining to behavior at clock time tm1 of developing device 107, according to the first embodiment of this invention.
Figure 6B:
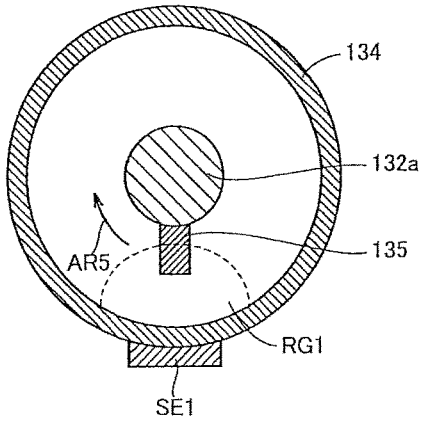
Figure 6C:
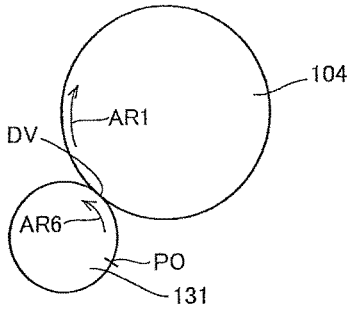

FIGS. 6A-6C is for explanation pertaining to behavior at clock time tm1 of developing device 107, according to the first embodiment of this invention. FIG. 6A is a graph showing alteration of outputting electrical voltage (V) of TCR sensor SE1 from moment to moment. FIG. 6B is a cross sectional view showing a state of agitating screw 132 at clock time tm1. FIG. 6C is a cross sectional view showing a state of developing roller 131 at clock time tm1. The time axis (the horizontal axis) in the graph of FIG. 6A corresponds to the rotational position of agitating screw 132.

In the following explanation, IDC sensor SE2 outputs electrical voltage corresponding to toner density at the developing location DV on the surface of photo conductor 104.

Referring to FIGS. 6A-6C, in the output waveform of TCR sensor SE1 (curved line L1), ripples occur with period T1. The ripples are caused by detection subsidiary part 135. Hence, period T1 corresponds to the rotation period of agitating screw 132. Clock time tm1 when the curved line L1 peaks (clock time when a ripple occurs) corresponds to clock time when detection subsidiary part 135 passes in front of TCR sensor SE1. At clock time tm1, the rotational position PO which is explained later of developing roller 131 does not reach the developing location DV.

Figure 7A:
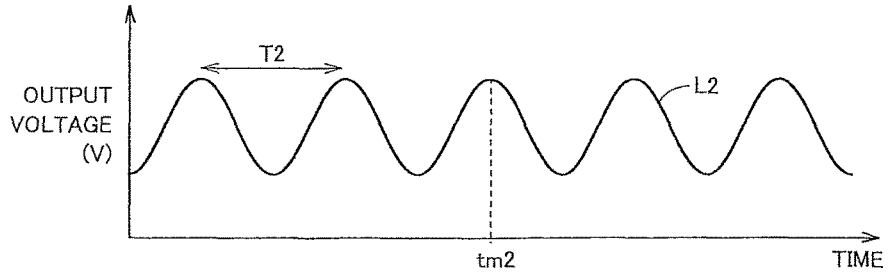
FIGS. 7A-7C is for explanation pertaining to behavior at clock time tm2 of developing device 107, according to the first embodiment of this invention.
Figure 7B:
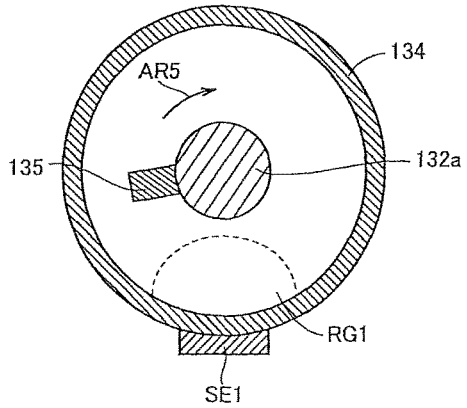
Figure 7C:
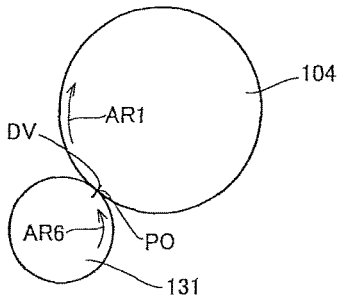

FIGS. 7A-7C is for explanation pertaining to behavior at clock time tm2 of developing device 107, according to the first embodiment of this invention. FIG. 7A is a graph showing alteration of outputting electrical voltage (V) of IDC sensor SE2 from moment to moment. FIG. 7B is a cross sectional view showing a state of agitating screw 132 at clock time tm2. FIG. 7C is a cross sectional view showing a state of developing roller 131 at clock time tm2. The time axis (the horizontal axis) in the graph of FIG. 7A corresponds to the rotational position of photo conductor 104.

Referring to FIGS. 7A-7C, in parallel with detection by TCR sensor SE1, image forming apparatus 100 forms a solid image of which the length in the sub scanning direction corresponds to at least one round of developing roller 131 (an image to form a toner image covering the entire image forming area), on the surface of photo conductor 104. The toner density is detected by using IDC sensor SE2.

When the solid image was formed on the surface of photo conductor 104, toner density (curved line L2) of the toner image periodically changes with period T2. This periodical fluctuation of toner density is caused by density ununiformity in the circumferential direction of developing roller 131, generated by runout of developing roller 131. Hence, period T2 corresponds to the rotation period of developing roller 131. Clock time tm2 is when curved line L2 reaches the maximum value. At clock time tm2, the distance between the rotational position PO and photo conductor 104 becomes the minimum value, and the rotational position PO of developing roller 131 passes through the developing location DV.

The clock time when curved line L2 reaches a minimum value can be employed as clock time tm2. In this instance, clock time tm2 is when a portion of developing roller 131 to which the distance from photo conductor 104 shown in FIG. 7C is a maximum passes through developing location DV.

Image forming apparatus 100 calculates time ΔT which is the difference between clock time tm1 and clock time tm2. Time ΔT corresponds to a deviation amount between periodicity of ripples detected by using TCR sensor SE1 and periodicity of toner density detected by using IDC sensor SE2 (a deviation amount between a phase in which a ripple occurs and a phase in which the toner density becomes a maximum value). Time ΔT is information indicates the rotational position of developing roller 131.

More specifically, when the ratio of revolutions of agitating screw 132 to revolutions of developing roller 131 is 1:1, the rotational position of developing roller 131 can be calculated based on time ΔT and ripple period T1. In case that the ratio of revolutions of developing roller 131 to revolutions of agitating screw 132 is not 1:1, the rotational position of developing roller 131 can be calculated, as long as the ratio of revolutions of developing roller 131 to revolutions of agitating screw 132 is comprehended.

Since the developing location DV and the detecting location of IDC sensor SE2 are different in actuality, the difference may be corrected. However, the deviation amount between the developing location DV and the detecting location of IDC sensor SE2 is constant at all times. Then, there is no problem even if the correction is not performed.

Next, image forming apparatus 100 calculates a developing bias curved line (a density correction Vdc curved line), based on toner density detected by using IDC sensor SE2 and calculated time ΔT.

Figure 8:
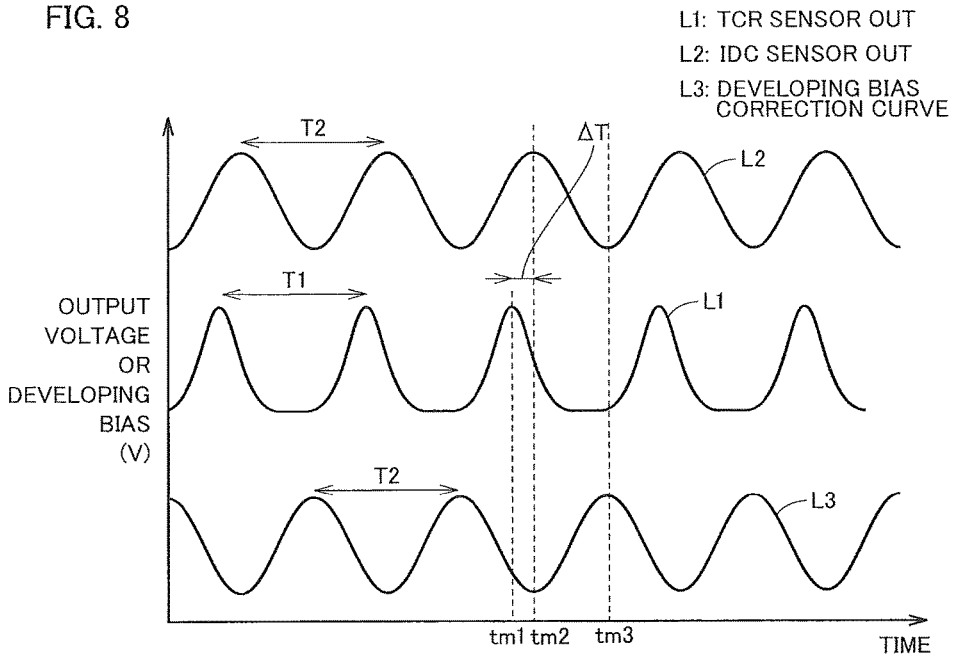
FIG. 8 schematically shows a developing bias correction curve calculated by image forming apparatus 100, according to the first embodiment of this invention.

FIG. 8 schematically shows a developing bias correction curve calculated by image forming apparatus 100, according to the first embodiment of this invention.

Referring to FIG. 8, the developing bias correction curve is a curved line which indicates the relationship between the rotational position of developing roller 131 and the developing bias. Image forming apparatus 100 calculates the developing bias correction curve, based on toner density detected by using IDC sensor SE2, to alleviate fluctuation of toner density which is based on the rotational position of developing roller 131. The period of the developing bias correction curve is equal to period T2 (the rotation period of developing roller 131). As an example, at a rotational position of the developing roller (which corresponds to clock time tm2) which the toner density reaches a maximum value in curved line L2, the developing bias in the developing bias correction curve is set as a minimum value. At a rotational position of the developing roller (which corresponds to clock time tm3) which the toner density reaches a minimum value in curved line L2, the developing bias in the developing bias correction curve is set as a maximum value.

The reference location of the developing bias correction curve is preferably set to when the distance between developing roller 131 and photo conductor 104 is narrow due to runout of developing roller 131 (where toner density reaches a maximum value, namely, the rotational position of developing roller 131 which corresponds to clock time tm2). The fluctuation of toner density based on the rotational position of developing roller 131 changes according to the environment and the number of printed sheets. Then, the developing bias correction curve is preferably updated each time an image stabilization process is performed.

When actual printing, image forming apparatus 100 confirms ripples in outputting electrical voltage of TCR sensor SE1, during preliminary behavior of starting up, after starting the printing. After entering the printable state, developing bias is begun to be applied in accordance with the developing bias correction curve at the timing of "ripple detection timing+the deviation amount", more specifically, the timing the rotational position of developing roller 131 where toner density becomes a maximum value reaches the developing location DV.

After starting applying developing bias in accordance with the developing bias correction curve, whether fluctuation of toner density is remedied or not may be confirmed by using IDC sensor SE2. In this instance, the detection result of IDC sensor SE2 is feed backed, to correct the developing bias correction curve and the deviation amount, so that images with little unevenness can be obtained.

Figure 9:
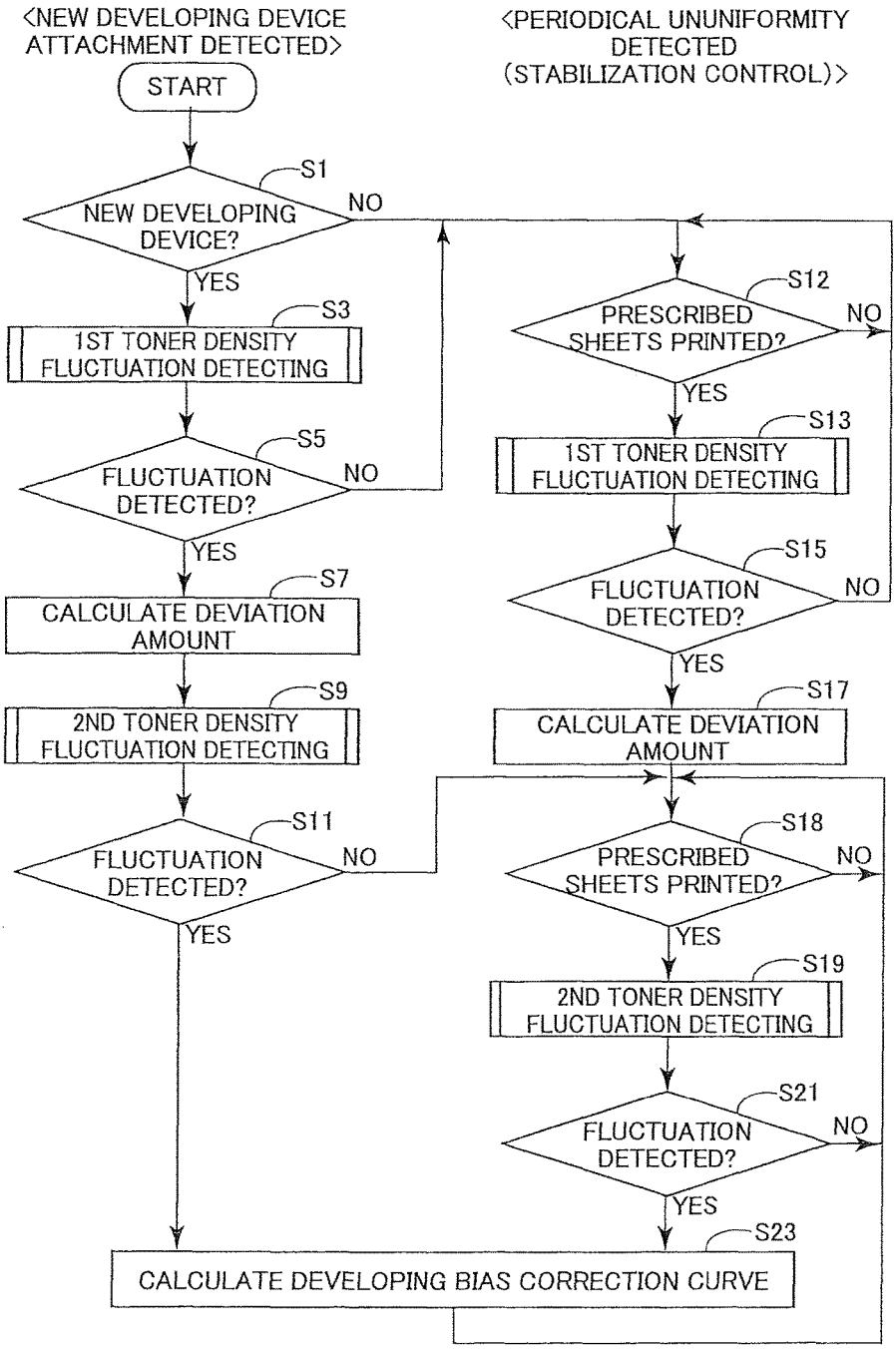
FIG. 9 shows a flowchart of behavior of image forming apparatus 100, according to the first embodiment of this invention.

FIG. 9 shows a flowchart of behavior of image forming apparatus 100, according to the first embodiment of this invention.

Referring to FIG. 9, CPU 201 of image forming apparatus 100 determines whether attachment of a new developing device 107 is detected or not (S1). Density ununiformity (periodical ununiformity) of developing roller 131 in the circumferential direction is caused by runout of developing roller 131. The runout of developing roller 131 is caused by the mechanical shape of developing roller 131 (a shape of the mag roller). Therefore, whether density ununiformity of developing roller 131 in the circumferential direction is occurred or not is preferably confirmed, when attachment of a new developing device 107 is detected.

At step S1, when attachment of new developing device 107 is detected (YES at S1). CPU 201 executes the first toner density fluctuation detecting process (S3).

Figure 10:
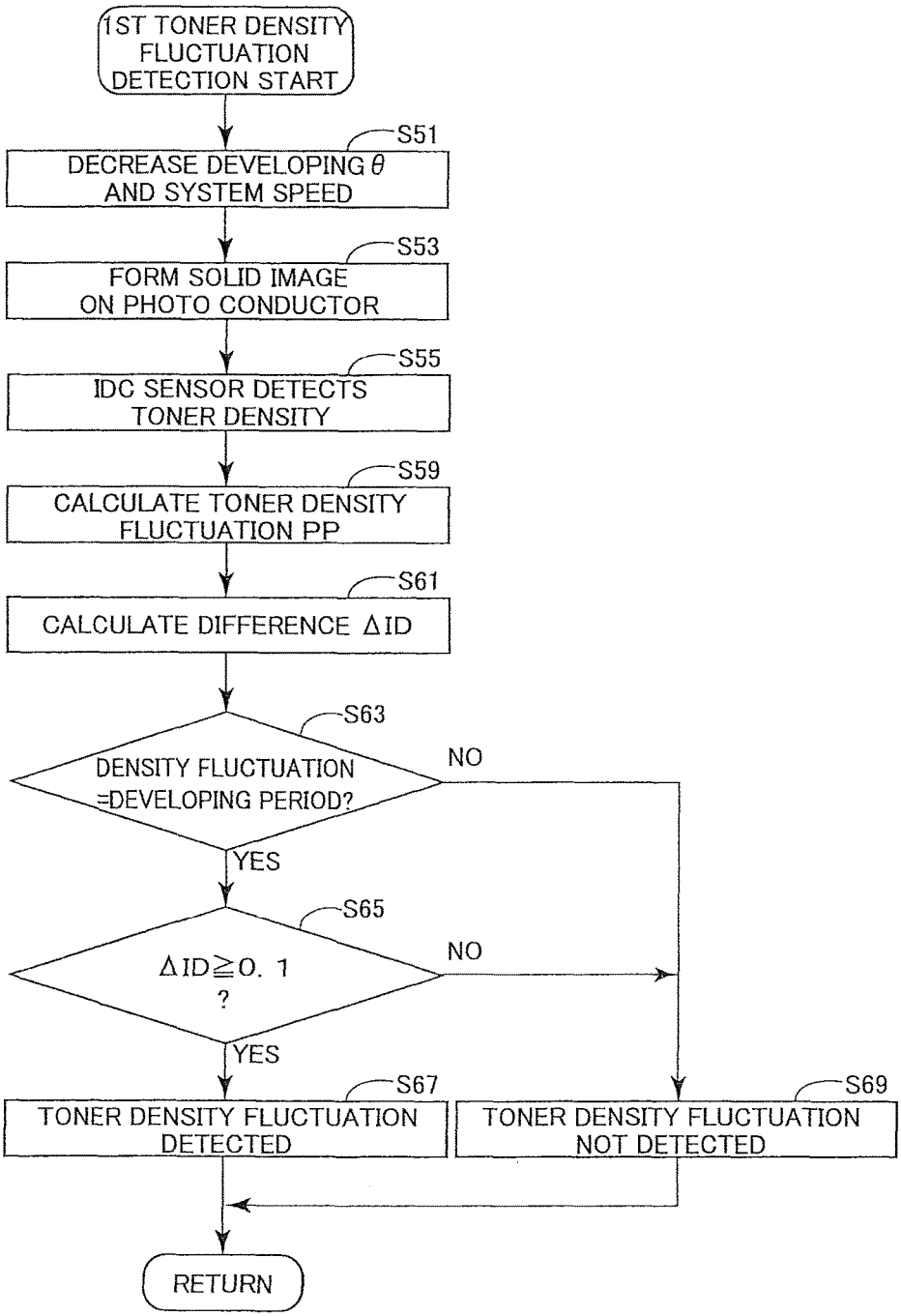
FIG. 10 shows a subroutine of the first toner density fluctuation detection process (S3 and S13) in FIG. 9.

FIG. 10 shows a subroutine of the first toner density fluctuation detection process (S3 and S13) in FIG. 9.

Referring to FIG. 10, in the first toner density fluctuation detection process, CPU 201 decreases developing θ from 1.8 which is a value of normal image forming to 1.2, and decreases the system speed to a speed that is half of a speed of normal image forming (S51). Developing θ is a ratio of the rotational speed of developing roller 131 to the rotational speed of photo conductor 104. Whether fluctuation of toner density caused by the rotational position of developing roller 131 is detected or not depends on process conditions of image forming apparatus 100. Since developing properties decrease by decreasing developing θ, detection sensitivity of fluctuation of toner density based on rotation of developing roller 131 can be enhanced. The detection accuracy of the rotational position of agitating screw 132 when a ripple occurs can be improved, by decreasing the system speed to half of the normal speed.

In the process of step S51, the toner density in the developer may be decreased from when normal image forming.

After step SM, CPU 201 forms a solid image on the surface of photo conductor 104 (S53), and detects the toner density by using IDC sensor SE2 (S55). CPU 201 converts outputting electrical voltage of IDC sensor SE2 to toner density (ID). Next, CPU 201 calculates PP (peak to peak, the amplitude) of fluctuation of toner density (S59). Next, CPU 201 calculates the difference ΔID between a reference value for PP which is a quality target of image forming apparatus 100 and the calculated PP value (S61). Next, CPU 201 determines whether the fluctuation of the toner density coincides with the developing period (the rotation period of developing roller 131) or not (S63). The developing period is calculated by the rotational speed and size of developing roller 131.

At step S63, when the fluctuation of toner density coincides with the developing period (YES at S63), CPU 201 determines whether the difference ΔID is more than or equal to 0.1, or not (S65).

At step S65, when the difference ΔID is more than or equal to 0.1 (YES at S65), CPU 201 determines that fluctuation of toner density caused by rotation of developing roller 131 is detected (S67), and returns to the main flowchart.

When the fluctuation of toner density does not coincide with the developing period at step S63 (NO at S63), or when the difference ΔID is less than 0.1 at step S65 (NO at S65), CPU 201 determines that fluctuation of toner density caused by rotation of developing roller 131 is not detected (S69), and returns to the main flowchart.

Referring to FIG. 9, after step S3, CPU 201 determines whether fluctuation of toner density was detected at the process of step S3 or not (S5).

At step S5, when fluctuation of toner density was detected (YES at S5), CPU 201 calculates a deviation amount between the ripple periodicity detected by using TCR sensor SE1 and the toner density periodicity detected by using IDC sensor SE2 (S7). The deviation amount does not change as long as rotation phases of developing roller 131 and agitating screw 132 does not deviate. Then, the deviation amount should be calculated once for one developing device 107.

After step S7, CPU 201 executes the second toner density fluctuation detecting process (S9).

Figure 11:
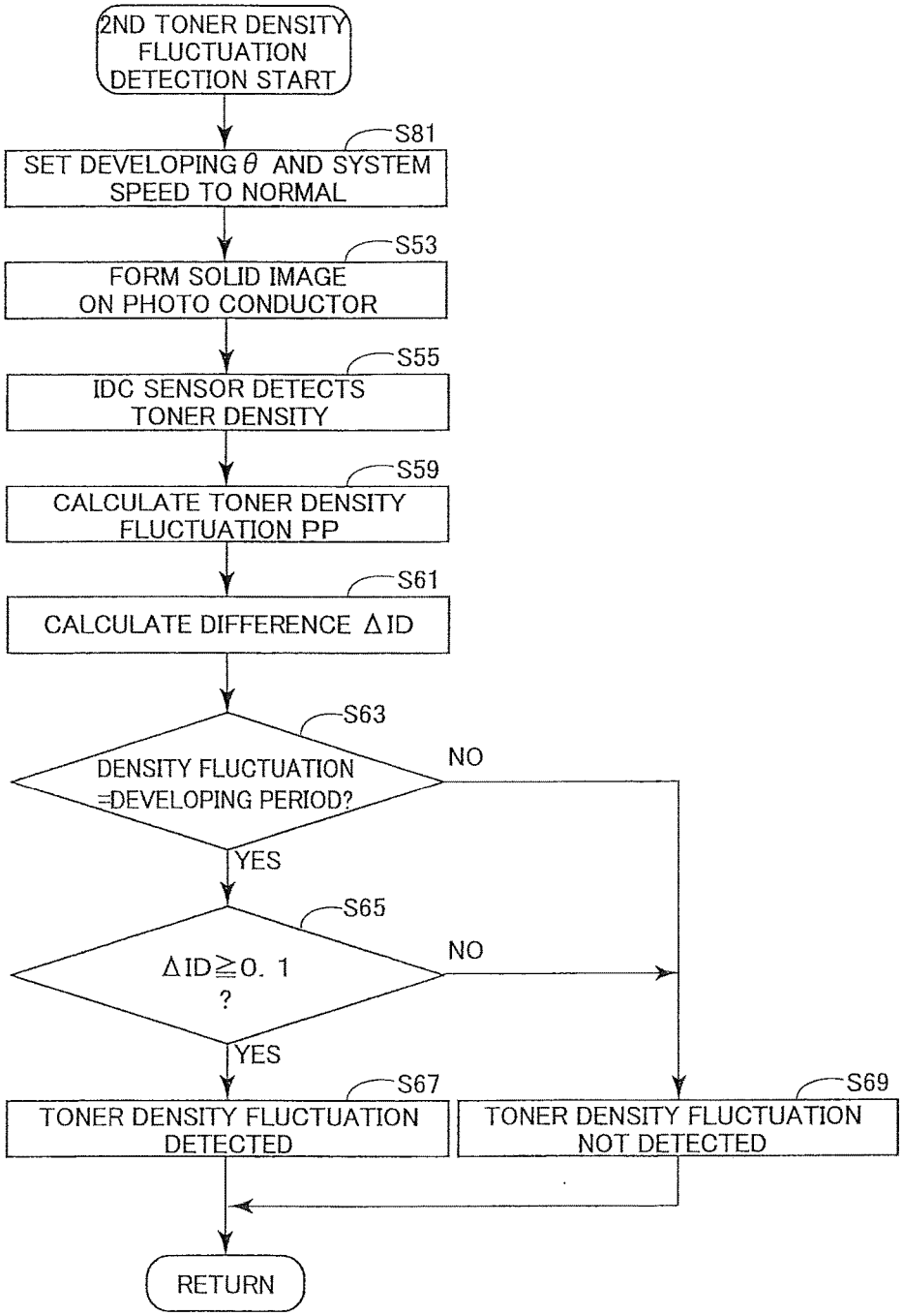
FIG. 11 shows a subroutine of the second toner density fluctuation detection process (S9 and S19) in FIG. 9.

FIG. 11 shows a subroutine of the second toner density fluctuation detection process (S9 and S19) in FIG. 9.

Referring to FIG. 11, in the second toner density fluctuation detection process, CPU 201 sets developing θ to normal 1.8, and sets the system speed to the normal speed (S81). After step S81, CPU 201 executes processes similar to step S53 and the following steps in the first toner density fluctuation detection process (S3) of FIG. 10, and returns to the main flowchart.

Referring to FIG. 9, after step S9, CPU 201 determines whether fluctuation of toner density was detected in the process of step S9 or not (S11).

At step S11, when fluctuation of toner density was detected (YES at S11), CPU 201 determines that fluctuation of toner density (periodical ununiformity) occurs, under the normal printing condition. In this instance, CPU 201 calculates the developing bias correction curve (S23), and steps in the process of step S18.

At step S11, when fluctuation of toner density was not detected (NO at S11), CPU 201 determines that fluctuation of toner density (periodical ununiformity) does not occur under the normal printing condition. In this instance, CPU 201 determines that detection of a deviation amount and calculation of the developing bias correction curve are unnecessary when the detection of new developing device 107, and steps in the process of step S18.

When attachment of new developing device 107 is not detected at step S1 (NO at S1), or fluctuation of toner density was not detected at step S5 (NO at S5), CPU 201 determines that detection of a deviation amount and calculation of the developing bias correction curve are unnecessary when the detection of new developing device 107, and steps in the process of step S12.

At step S12, CPU 201 determines whether printings were done on the prescribed number of paper sheets or not (S12). Until printings are done on the prescribed number of paper sheets, CPU 201 continues the process of step S12.

At step S12, when printings were done on the prescribed number of paper sheets (YES at S12), CPU 201 executes the first toner density fluctuation detection process (S13). When the number of printed sheets increases, there is the potential that fluctuation of toner density becomes tangible. Therefore, as presented above, the presence or absence of fluctuation of toner density is preferably detected, at the timing (for example, at the timing of an image stabilization process) when the number of printed sheets reaches a predetermined number (for example, a few hundreds to a few thousands).

After step S13, CPU 201 determines whether fluctuation of toner density was detected or not at the process of step S13 (S15).

At step S15, when fluctuation of toner density was not detected (NO at S15), CPU 201 steps in the process of step S12.

At step S5, when fluctuation of toner density was detected (YES at S15), CPU 201 calculates a deviation amount between periodicity of ripples detected by using TCR sensor SE1 and periodicity of toner density detected by using IDC sensor SE2 (S17).

After step S17, CPU 201 determines whether paper sheets of the prescribed number were printed or not (S18). Until paper sheets of the prescribed number are printed, CPU 201 continues the process of step S18.

At step S18, when paper sheets of the prescribed number were printed (YES at S18), CPU 201 executes the second toner density fluctuation detection process (S19). Next, CPU 201 determines whether fluctuation of toner density was detected or not at the process of step S19, or not (S21).

At step S21, when fluctuation of toner density was detected (YES at S21), CPU 201 calculates the developing bias correction curve (S23), and steps in the process of step S18.

At step S21, when fluctuation of toner density was not detected (NO at S21), CPU 201 determines that fluctuation of toner density (periodical ununiformity) does not occur under normal printing condition, and continues the normal printing mode. In this instance, CPU 201 steps in the process of step S18.

According to the embodiment, the rotational position of the developing roller is detected by using ripples in the output waveform of the TCR sensor, which are generated for each rotation of the agitating screw. A TCR sensor is installed by nature to detect magnetic permeability of developer filled in a developing device. Hence, the embodiment eliminates the need to install an expensive detector, such as a photo interrupter, an encoder, or the like. In consequence, the rotational position of the developing roller can be detected, preventing complication of the device configuration.

In addition, according to this embodiment, an IDC sensor is further used. Hence, the rotational position of the developing roller which causes unevenness of toner density (periodical ununiformity) is identified. Since the developing bias is corrected, based on the identified rotational position of the developing roller, unevenness of toner density which is caused by runout of the developing roller can be suppressed.

[The Second Embodiment]

Figure 12B:
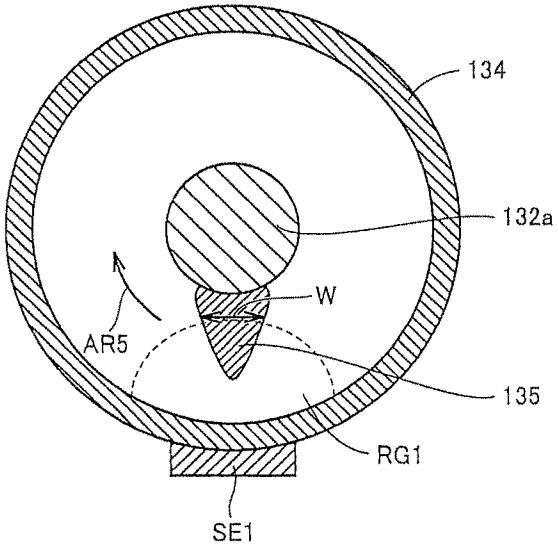
FIGS. 12A and 12B shows a cross sectional view of a structure adjacent to agitating screw 132 in developing device 107, according to the second embodiment of this invention.
Figure 12A:
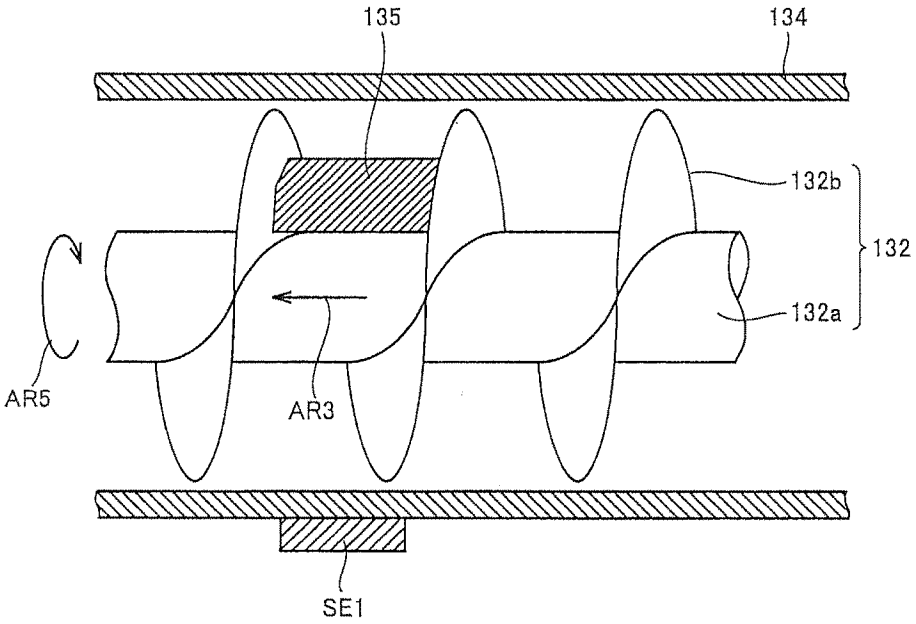

FIGS. 12A and 12B shows a cross sectional view of a structure adjacent to agitating screw 132 in developing device 107, according to the second embodiment of this invention. FIG. 12A is a cross sectional view showing a cross section parallel to the extending direction of rotation shaft 132*a*. FIG. 12B is a cross sectional view showing a cross section plane of which the normal line extends in the extending direction of rotation shaft 132*a*.

Referring to FIGS. 12A and 12B, detection subsidiary part 135 according to the embodiment has a plate shape as shown in the cross section of FIG. 12B, and tapers toward housing 134. The width W of detection subsidiary part 135 gets thinner little by little, with distance from rotation shaft 132*a* to approach housing 134.

The structure and behavior of image forming apparatus 100 other than the above mentioned are similar to the first embodiment. The explanations are not repeated.

A ripple occurs in the output waveform of TCR sensor SE1, at timing when the tip of detection subsidiary part 135 arrives at the center of detection range RG1. According to this embodiment, outputting electrical voltage of TCR sensor SE1 rapidly changes when a ripple occurs. The width of the ripple narrows in the direction of the rotational position of agitating screw 132. In consequence, the rotational position of agitating screw 132 equipped with detection subsidiary part 135 can be identified with more precision, and degree of detection accuracy of the rotational position of agitating screw 132 improves.

[The Third Embodiment]

Figure 13B:
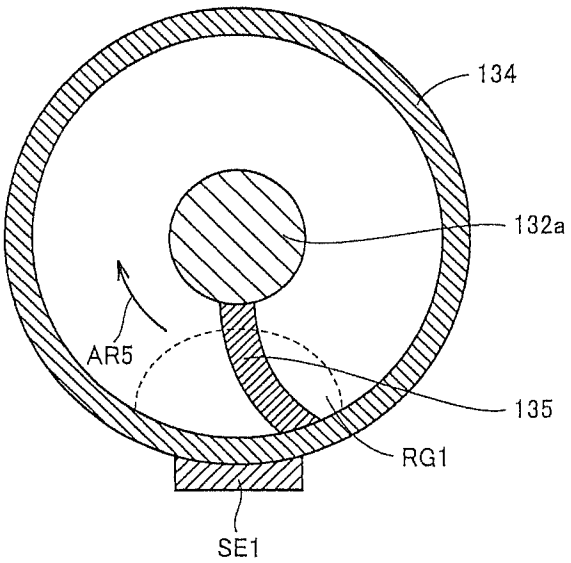
FIGS. 13A and 13B shows a cross sectional view of a structure adjacent to agitating screw 132 in developing device 107, according to the third embodiment of this invention.
Figure 13A:
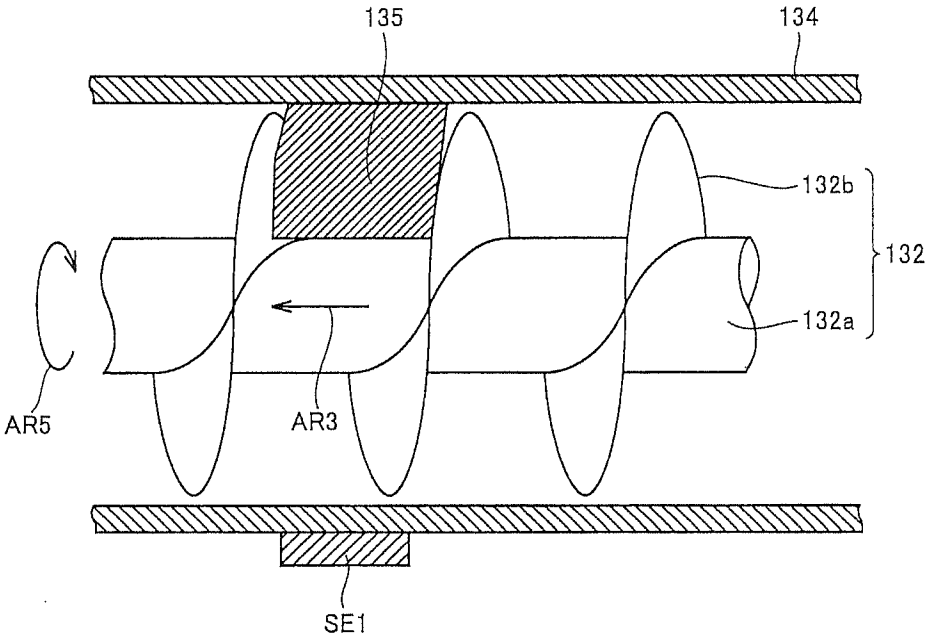

FIGS. 13A and 13B shows a cross sectional view of a structure adjacent to agitating screw 132 in developing device 107, according to the third embodiment of this invention. FIG. 13A is a cross sectional view showing a cross section parallel to the extending direction of rotation shaft 132*a*. FIG. 13B is a cross sectional view showing a cross section plane of which the normal line extends in the extending direction of rotation shaft 132*a*.

Referring to FIGS. 13A and 13B, according to detection subsidiary part 135 of the embodiment, the tip is placed in contact with an inner periphery of housing 134. Detection subsidiary part 135 has a plate shape section as shown in the cross section of FIG. 13B. Detection subsidiary part 135 is preferably made of an elastic body. When detection subsidiary part 135 is made of an elastic body, detection subsidiary part 135 can be bent by force (force to prevent the rotation) received from housing 134.

The structure and behavior of image forming apparatus 100 other than the above mentioned are similar to the first embodiment. The explanations are not repeated.

According to this embodiment, the volume ratio of detection subsidiary part 135 to detection range RG1 when detection subsidiary part 135 passes through detection range RG1 can be increased. Herewith, a ripple which occurs in outputting electrical voltage of TCR sensor SE1 becomes larger. In consequence, the rotational position of agitating screw 132 equipped with detection subsidiary part 135 can be identified with more precision, and degree of detection accuracy of the rotational position of agitating screw 132 improves.

Figure 14:
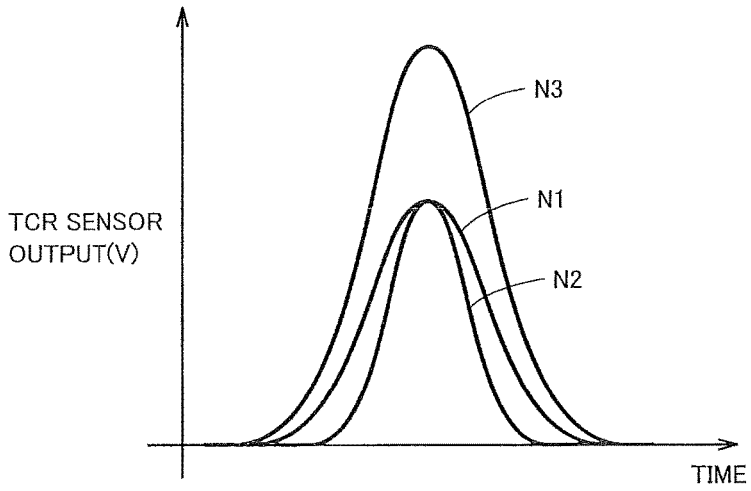
FIG. 14 schematically shows a graph of ripples generated by detection subsidiary part 135 of the first, the second, and the third embodiments.

FIG. 14 schematically shows a graph of ripples generated by detection subsidiary part 135 of the first, the second, and the third embodiments.

Referring to FIG. 14, the width of ripple N2 when using detection subsidiary part 135 according the second embodiment is narrower, as compared to ripple N1 generated by detection subsidiary part 135 of the first embodiment. Ripple N3 by using detection subsidiary part 135 of the third embodiment is larger, as compared to ripples N1 and N2.

[Effect of the Embodiments]

According to the embodiments, a developing device, an image forming apparatus, and a control program for a developing device which can detect the rotational position of the developing roller can be provided, preventing a complication of the device configuration.

[Others]

An image forming apparatus of this invention may be an MFP, a black-and-white printer, a color printer, a copying machine, a facsimile device, or the like.

According to the above mentioned embodiment, a TCR sensor is installed facing the agitating screw. The TCR sensor may be installed facing a screw which agitates or conveys developer including toner. The screw is rotationally driven, wherein the ratio of the number of rotation of the screw to the developing roller is constant. The TCR sensor may be installed facing a feeding screw.

The above mentioned embodiments can be appropriately combined with each other. For example, the structure of detection subsidiary part 135 which tapers toward housing 134 in the second embodiment, and the structure of detection subsidiary part 135 of which the tip keeps contact with an inner periphery of housing 134 in the third embodiment can be combined.

The processes in the above mentioned embodiments can be performed by software and a hardware circuit. A computer program which executes the processes in the above embodiments can be provided. The program may be provided recorded in recording media of CD-ROMs, flexible disks, hard disks, ROMs, RAMs, memory cards, or the like to users. The program is executed by a computer of a CPU or the like. The program may be downloaded to a device via communication lines like the internet. The processes explained in the above flowcharts and the description are executed by a CPU in line with the program.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A developing device comprising:

a developing roller rotationally driven, for developing an electrostatic latent image formed on a surface of an image supporting body with toner, a screw rotationally driven so that a ratio of a number of rotations of the screw to a number of rotations of the developing roller being rotationally driven is constant, and a processor, wherein the processor is configured to:

detect first toner density in developer by using a sensor installed facing the screw, during rotationally drive of the screw, and detect information indicating a rotational position of the developing roller, based on ripples which occur in the first toner density detected.

2. The developing device according to claim 1, wherein the processor is further configured to:

detect second toner density in a toner image formed on the surface of the image supporting body, during rotationally drive of the screw, and detect the information indicating the rotational position of the developing roller, further based on the second toner density detected by using a second sensor.

3. The developing device according to claim 2, wherein the processor is further configured to:

detect a deviation amount between periodicity of the ripples and periodicity of the second toner density detected.

4. The developing device according to claim 3, wherein the processor is further configured to:

calculate a curved line which indicates relationship between the rotational position of the developing roller and a developing bias, based on the second toner density detected and the deviation amount, wherein the developing bias is an electrical voltage applied to the developing roller when the developing roller develops the electrostatic latent image.

5. The developing device according to claim 2, wherein the processor is further configured to:

detect the first toner density and the second toner density, in a state in which system speed is slower than system speed of normal image forming.

6. The developing device according to claim 2, wherein the processor is further configured to:

detect the first toner density and the second toner density, in a state in which a ratio of the rotational speed of the developing roller to a rotational speed of the image supporting body is reduced from normal image forming.

7. The developing device according to claim 2, wherein the processor is further configured to:

detect the first toner density and the second toner density, in a state in which the toner density in the developer is lowered from normal image forming.

8. The developing device according to claim 2, wherein the processor is further configured to:

detect the first toner density and the second toner density, when a new developing device is installed on an image forming apparatus.

9. The developing device according to claim 1, wherein:

the faster one of a rotational speed of the developing roller and a rotational speed of the screw is an integral multiple of the slower one of the rotational speed of the developing roller and the rotational speed of the screw.

10. The developing device according to claim 1, further comprising:

a housing in which developer is stored, the screw configured as an agitating screw to convey the developer, agitating the developer, and a feeding screw to provide the developer conveyed by the agitating screw for the developing roller, wherein the housing includes a partition wall which separates the agitating screw and the feeding screw, and the sensor is provided near an aperture which is made on the wall, facing the agitating screw.

11. The developing device according to claim 1, further comprising:

a detection subsidiary part which is fixed to the screw at a location facing the sensor, to improve sensitivity of the ripples.

12. The developing device according to claim 11, wherein:

the detection subsidiary part extends parallel with an axis of rotation of the screw between spiral protruding portions which are formed on an outer periphery of a rotation shaft of the screw, wherein the spiral protruding portions constitute the screw.

13. The developing device according to claim 12, wherein:

the detection subsidiary part gets thinner, with distance from the rotation shaft of the screw, when viewed from an extending direction of the axis of rotation.

14. The developing device according to claim 11, wherein:

the detection subsidiary part is made of an elastic body, and keeps contact with a housing containing the screw.

15. An image forming apparatus comprising:

the developing device according to claim 1, and a transfer device to transfer a toner image, obtained by developing of the developing roller, to a recording medium.

16. A non-transitory computer-readable recording medium storing a controlling program for a developing device, wherein the developing device comprising:

a developing roller rotationally driven, for developing an electrostatic latent image formed on a surface of an image supporting body with toner, and a screw rotationally driven so that a ratio of a number of rotations of the screw to a number of rotations of the developing roller being rotationally driven is constant, wherein the program causes a computer to execute the steps of:

detect toner density in developer by using a sensor installed facing the screw, during rotationally drive of the screw, and detect information indicating a rotational position of the developing roller, based on ripples which occur in the toner density detected.

17. A method for controlling a developing device, wherein the developing device comprising:

a developing roller rotationally driven, for developing an electrostatic latent image formed on a surface of an image supporting body with toner, and a screw rotationally driven so that a ratio of a number of rotations of the screw to a number of rotations of the developing roller being rotationally driven is constant, wherein the method is configured to:

detect toner density in developer by using a sensor installed facing the screw, during rotationally drive of the screw, and detect information indicating a rotational position of the developing roller, based on ripples which occur in the toner density detected.

* * * * *